US007283779B2

(12) United States Patent
Fukuda

(10) Patent No.: US 7,283,779 B2
(45) Date of Patent: Oct. 16, 2007

(54) FIXING DEVICE AND IMAGE FORMING DEVICE USING THE SAME

(75) Inventor: Yuichi Fukuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 108 days.

(21) Appl. No.: 11/059,539

(22) Filed: Feb. 17, 2005

(65) Prior Publication Data

US 2006/0029443 A1 Feb. 9, 2006

(30) Foreign Application Priority Data

Aug. 3, 2004 (JP) ..... P.2004-226794

(51) Int. Cl.
*G03G 15/20* (2006.01)

(52) U.S. Cl. ..... 399/329; 219/216

(58) Field of Classification Search ..... 399/328, 399/329, 341, 322; 347/156; 118/60; 219/216, 219/388

See application file for complete search history.

(56) References Cited

U.S. PATENT DOCUMENTS 5,463,454 A * 10/1995 Yasuda et al. ..... 399/328
6,092,891 A * 7/2000 Okubo et al. ..... 219/216 X
6,122,476 A * 9/2000 Bowler, Jr. ..... 399/328
6,496,680 B2 * 12/2002 Fujimoto et al. ..... 399/329
6,907,221 B2 * 6/2005 Tanino et al. ..... 399/329
2003/0103788 A1 * 6/2003 Yura et al. ..... 399/329
2005/0025537 A1 * 2/2005 Echigo et al. ..... 399/329

FOREIGN PATENT DOCUMENTS

JP 03-278079 A * 12/1991
JP 08-328412 12/1996
JP 2000-338803 12/2000

* cited by examiner

*Primary Examiner*—Sophia S. Chen
(74) *Attorney, Agent, or Firm*—Morgan, Lewis & Bockius LLP

(57) ABSTRACT

A fixing device includes a heat unit that heats a toner image on a first recording medium and a heat absorption and transmission unit that absorbs heat of the first recording medium sent from the heat unit and transmits the heat thus absorbed to a second recording medium to be sent to the heat unit. The heat absorption and transmission unit includes a belt member circulated around tensile members to transport the first and second recording media. The belt member has a heat absorption portion and a heat transmission portion downstream and upstream from the heat unit, respectively. The heat absorption portion contacts the first recording medium and absorbs heat in a state that periphery of a contact region is thermally insulated, and the heat transmission portion contacts the second recording medium and transmits heat in a state that a periphery of a contact region is thermally insulated.

21 Claims, 10 Drawing Sheets

FIXING DEVICE AND IMAGE FORMING DEVICE USING THE SAME

BACKGROUND OF THE INVENTION

1. Field of the Invention

The present invention relates to the improvement of a fixing device used in an image forming device such as a printer or a copying machine using an electrophotographic system, an electrostatic recording system etc. and the improvement of an image forming device using the fixing device.

2. Description of the Related Art

Conventionally, as such a kind of the image forming device, there is know one in which toner images of respective color components formed on a photosensitive member etc. are primary-transferred sequentially on an intermediate transfer member and multi-color toner images on the intermediate transfer member are collectively transferred on a sheet of paper by a secondary transfer device (collectively transfer device).

In recent years, such a color image forming device has been strongly required to be high speed, be miniaturized and save energy. In particular, a heat fixer, which most consumes energy in the image forming process, has been required to be applied with an energy saving technique (low power technique) aimed to reduce environment load.

In accordance with such a demand, there is disclosed a technique in which heat of a sheet of paper after the fixation and transported from a fixing device is directly or indirectly transmitted to a sheet of paper before the fixation to pre-heat the sheet of paper prior to the fixing process, thereby to reduce heat energy required in the fixing process performed after the pre-heating and increase a fixing speed without increasing an electric power required for heating (see JP-A-8-38412 (embodiment, FIGS. 2 to 15) and JP-A-2000-33803 (embodiment, FIG. 1), for example).

However, in such a technique, the configuration to make a sheet of paper after the fixation directly contact a sheet of paper before the fixation can be applied only to a continuous sheet of paper (roll sheet of paper). That is, since such a technique cannot be applied only to a cut sheet of paper, there arises a problem that the general purpose property of a sheet of paper to be applied is limited.

Further, as shown in FIG. 10, there is proposed a method in which, at the time of fixing a toner image transferred from a photosensitive member 101 on a sheet of paper 102 by a fixing device 103, a heat pipe 106 is provided between an upstream side portion 104 and a downstream side portion 105 of the fixing device 103 thereby to transmit heat of the sheet of paper 102 after the fixation at the downstream side portion 105 to the upstream side portion 104 (see JP-A-8-38412, for example).

In such a configuration having a heat pipe with a block or the configuration in which heat of a sheet of paper after the fixation is transmitted to a sheet of paper before the fixation via a heat transmission unit such as a heat transmission block, a heat transmission plate or a combination of a heat transmission roller and a belt, a cut sheet of paper can be applied and so the general purpose property of a sheet of paper can be secured. However, in order to make a heat quantity steady at the heat transmission unit to obtain sufficient heat absorption/heat transmission effect, it is required that the temperature of the heat transmission unit is repeatedly increased through heat transmission from sheets of paper and approaches the temperature of a sheet of paper just after the fixation. That is, in such a configuration, since it takes much time to increase the temperature of the heat transmission unit, there arises a problem that heating energy for the fixing procedure cannot be reduced immediately.

Particularly, in such a case, a middle or small sized image forming device which frequently performs printing or copying operation of several ten sheets of paper or less can hardly attain the aforesaid effect.

Further, in a method of applying auxiliary heat to the heat transmission unit in order to attain the heat absorption/heat transmission effect immediately (increase the rising speed of the effect), much energy is consumed and so this method is not a good way for saving energy.

Further, as shown in FIG. 11, there is proposed a method which is arranged in the following manner (see JP-A-8-38412, for example). That is, a belt 201 and a paper transport belt 202 are disposed in an opposite manner, a heater 203 is provided at the inside of the belt 201 and press-contact plates 204 are provided at the both sides (upstream and downstream sides) of the heater 203 to constitute a press contact state between the belt 201 and the paper transport belt 202 thereby to transport a paper 205 between the belt 201 and the paper transport belt 202. In this configuration, further a heat transmission belt 206 that moves in an opposite direction to the moving direction of the paper transport belt 202 is provided at the inside of the paper transport belt 202 to transmit absorbed heat at the downstream side of the heater 203 toward the upstream side thereby to preheat the paper 205.

However, in such a configuration, the transport belt to transport a sheet of paper does not serve as a heat transmission medium and a heat transmission belt is provided separately from the transport belt, whereby the configuration is complicated and the heat transmission efficiency is degraded.

As described above, each of the aforesaid conventional techniques merely transmits heat of a sheet of paper after the fixation indirectly to a sheet of paper before the fixation via a heat absorption transmission unit.

SUMMARY OF THE INVENTION

The invention intends to address the aforesaid technical problem and the invention provides a fixing device in which, at the time of absorbing heat from a recording medium after the fixation and transmitting the heat to a recording medium before the fixation, heat absorption and transmission is performed directly so as to reduce a heat energy, and also provides an image forming device using the fixing device.

According to an aspect of the present invention, fixing device includes a heat unit that heats a toner image on a first recording medium and a heat absorption and transmission unit that absorbs heat of the first recording medium sent from the heat unit and transmits the heat thus absorbed to a second recording medium to be sent to the heat unit. The heat absorption and transmission unit includes a belt member circulated around tensile members to transport the first and second recording media. The belt member has a heat absorption portion and a heat transmission portion downstream and upstream from the heat unit, respectively. The heat absorption portion contacts the first recording medium and absorbs heat in a state that periphery of a contact region is thermally insulated, and the heat transmission portion contacts the second recording medium and transmits heat in a state that a periphery of a contact region is thermally insulated.

According to another aspect of the present invention, an image forming device includes an image forming unit that forms a toner image on a recording medium, and the above-described fixing device that fixes the toner image formed on the first recoding medium.

Thus, the belt member has both the transporting function for the recording medium and the heat absorption and transmission function for the recording medium, so that heat can be directly absorbed from and transmitted to the recording medium. Accordingly, as compared with the conventional indirect heat absorption and transmission technique, the invention can reduce an amount of heat energy required at the time of fixation to a large extent and so the energy-saved fixing device can be realized.

BRIEF DESCRIPTION OF THE DRAWINGS

Embodiment of the present invention will be described in detail based on the following figures, wherein.

DETAILED DESCRIPTION OF THE INVENTION

The invention will be explained in detail based on the embodiments shown in attached drawings.

Figure 1A:
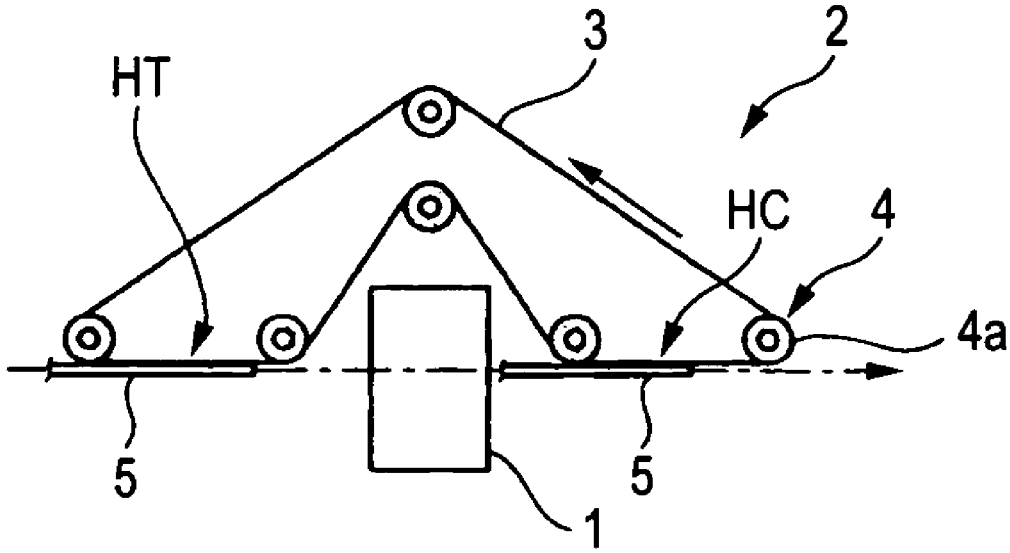
FIGS. 1A and 1B are explanatory diagrams showing the configuration of a fixing device according to the invention.
Figure 1B:
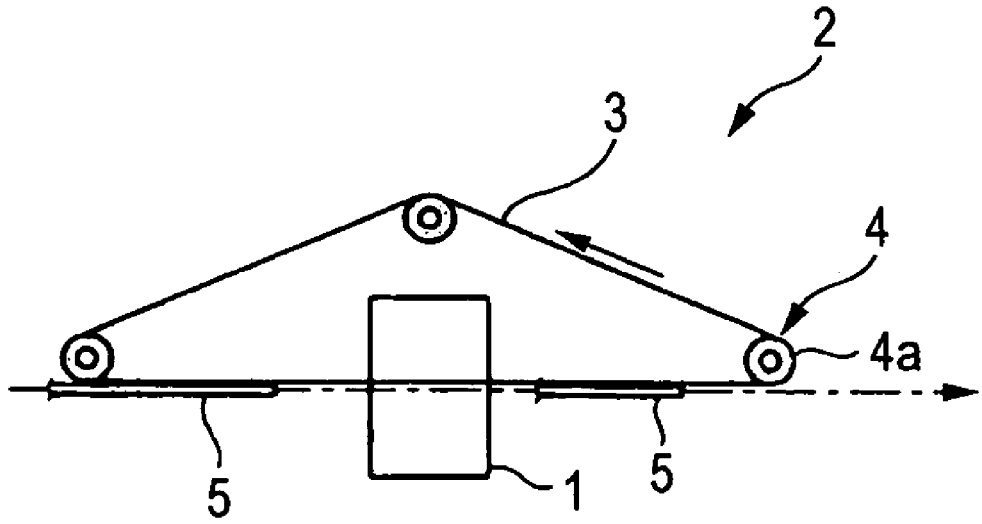

As shown in FIGS. 1A and 1B, the fixing device according to embodiments of the invention is arranged to include a heat unit 1 to heat a toner image on a recording medium 5, and a heat absorption and transmission unit 2 to absorb heat of the recording medium 5 sent from the heat unit 1 and transmits the heat thus absorbed to another recording medium 5 to be sent to the heat unit 1, the heat absorption and transmission unit 2 includes a belt member 3 which is stretched over plural tensile members 4 and circulated around the plural tensile members to transport the recording medium 5, wherein the belt member 3 is provided at the downstream side of the heat unit 1 with a heat absorption portion HC which contacts the recording medium 5 and absorbs heat from the recording medium in a state that the periphery of the area facing to the contact area is thermally insulated, and further provided at the upstream side of the heat unit 1 with a heat transmission portion HT which contacts the another recording medium 5 and transmits heat to the another recording medium in a state that the periphery of the area facing to the contact area is thermally insulated.

Thus, although the conventional technique is configured to indirectly absorb and transmit heat by using the member having a heat absorption and transmission function in separation from the transporting member having the function of transporting the recording medium 5, the embodiments of the present invention largely differs from the conventional technique in that the belt member 3 has both a transporting function for the recording medium and a heat absorption and transmission function for the recording medium 5 so as to directly absorb and transmit heat.

In such a technical unit, the subjective fixing device according to the embodiments of the invention is arranged to fix toner images formed on the recording medium 5 by using the heat unit 1. In this case, the heat unit 1 is merely required to promote the fixing process of the toner images on the recording medium 5 and includes one employing a fixing system using only the heating process or using both the heating and pressurizing processes etc., for example.

Further, since the belt member 3 is used as the heat absorption and transmission unit 2, the heat absorption and transmission unit can make its thermal capacity relatively small and also can make its contact area with the recording medium 5 large, the heat absorption and transmission can be made efficiently.

Further, since the heat absorption portion HC and the heat transmission portion HT are configured by the contact areas between the belt member 3 and the recording medium 5 and heat is effectively absorbed by the heat absorption portion HC, heat thus absorbed can be effectively transmitted to the recording medium 5 before fixation and so the heat efficiency can be improved. Incidentally, the number of the belt members 3 is not particularly limited. For example, two belt members 3 may be used so as to sandwich the recording medium 5 therebetween so long as the heat absorption portion HC and the heat transmission portion HT are provided on the downstream side and the upstream side of the heat unit 1, respectively. In this case, since the transportation member (corresponding to the belt member 3 in the embodiments of this invention) of the recording medium 5 itself absorbs and transmits heat, the fixing device with the simple configuration and good heat efficiency can be realized.

Incidentally, "the state that the periphery of the area facing to the contact area is thermally insulated" includes a state that the periphery of the contact area between the belt member 3 and the recording medium 5 is thermally insulated by the atmosphere or a state that the periphery of the contact area contacts to a heat insulation member. The recording medium 5 may be sandwiched by the belt members from the both sides thereof.

Further, in an embodiment of this invention, as shown in FIG. 1A, the belt member 3 may be disposed to be spaced apart from the heat unit 1 in order to prevent the degradation of the heat resisting property of the belt member 3 thereby to elongate the lifetime thereof. Further, as shown in FIG. 1B, the belt member 3 may be disposed so as to pass the heating portion of the heat unit 1 in order to simplify the configuration of the device by using the belt member 3 with heat resisting property. In particular, according to this configuration of passing the belt member through the heating portion, since the long area on the downstream side from the nip part of the heat unit 1 can be used effectively as the heat absorption portion HC, the heat absorption by the belt member 3 can be performed at an earlier stage. Thus, the embodiment of the invention can be applied even when a process speed increases.

The tensile member 4 according to the embodiments of the invention serves to keep the circulation path of the belt member 3 and circulate the belt member 3. The tensile member may be provided with the heat insulation layer 4*a* in order to effectively absorb heat by the heat absorption portion HC at the belt member 3 and to effectively transport the absorbed heat to the heat transmission portion HT.

Since the tensile member 4 is provided with the heat insulation layer 4*a,* among the entire heat energy absorbed by the belt member 3, an amount of heat energy reduced due to the contact with the tensile member 4 (an amount of heat energy absorbed by the tensile member 4 through the thermal transmission) can be made small, whereby the heat absorption and the heat transmission can be performed further effectively at the belt member 3. The heat insulation layer 4*a* may be configured by laminating foam members on the surface of the tensile member 4. Alternatively, the tensile member 4 itself may be configured by a heat insulation member, for example. In the each case, the thickness etc. of the layer is not particularly limited.

When an elastic foam material is used as the material of the heat insulation layer 4*a,* the heat insulation property can be improved in addition to the heat insulation effects of the bubbles of the foam. In this case, typical examples of the elastic foam material are foaming urethane, foaming silicone etc.

Further, when the heat insulation layer is provided with an uneven surface so as to reduce the contact area contacting with the belt member 3, the contact area can be reduced when the tensile member 4 contacts the belt member 3. As a result, an amount of heat absorbed on the tensile member 4 side can be reduced and so the heat insulation effect can be further improved. The configuration of the heat insulation layer 4*a* is not particularly limited so long as the belt member 3 can be circulated. For example, the heat insulation layer may be configured in a manner that convex portions are discretely disposed in the direction orthogonal to the rotation shaft of the tensile member 4 or that the convex portions are discretely disposed in the direction oblique to the rotation shaft.

According to the embodiments of the invention, when the tensile member 4 is configured by forming the heat insulation layer 4*a* on the surfaced of a cylindrical roller made of metal, the tensile member 4 excellent in the processing property and the rigidity can be realized. Further, since the roller of the tensile member 4 is configured as a cylindrical shape, the thermal capacity of the tensile member 4 itself can be made small. Thus, even when heat of the belt member 3 is transmitted to the metal roller via the heat insulation layer 4*a,* the temperature increase can be saturated in a short time and so the effective heat transmission from the belt member 3 to the recording medium 5 can be performed quickly. Further, particularly, when the cylindrical metal roller is configured to have a thin thickness, the thermal capacity of the tensile member 4 itself can be made further small and so the aforesaid effects becomes more remarkable.

Further, according to the embodiments of the invention, each of the heat absorption portion HA and the heat transmission portion HT of the belt member 3 may be arranged to contact only one side surface of the recording medium 5 in order to effectively absorb heat from the recording medium 5 and transmit the absorbed heat to the recording medium 5. According to this arrangement, the thermal capacity of the belt member 3 to absorb heat from and transmitting the heat to the recording medium 5 can be made larger as compared with the case where the belt members 3 contact the both side surfaces of the recording medium 5. Further, in this case, since the one side surface of the recording medium 5 can be exposed to the atmosphere of a quite small thermal conductivity, the heat absorption from and the heat transmission to the recording medium 5 can be performed more efficiently.

Further, in this case, the belt member 3 may be arranged to contact, at each of the heat absorption portion HC and the heat transmission portion HT, the surface of the recording medium 5 opposing to the surface thereof on which toner images are formed. According to this arrangement, the belt member 3 can be prevented from contacting with toner images before fixation, so that the degradation of the image quality can be prevented. At each of the heat absorption portion HC and the heat transmission portion HT, the direction of the member 5 contacting with the belt member 3 (that is, whether the recording medium 5 is disposed above or beneath the belt member 3) is not particularly limited. However, when the recording medium 5 is disposed just beneath the belt member 3, the recording medium 5 may be made contact and held to the belt member 3 disposed above the recording medium 5 at a required position by electrostatic attraction or the like.

The invention is not only applied to the aforesaid fixing device but also applied to the image forming device. In the case of being applied to the image forming device, the image forming device may be arranged to include an image forming unit to form a toner image on a recording medium 5, and a fixing device to fix the toner image formed on the recoding medium 5, wherein the fixing device configured in the aforesaid manner is employed.

FIRST EMBODIMENT

Figure 2:
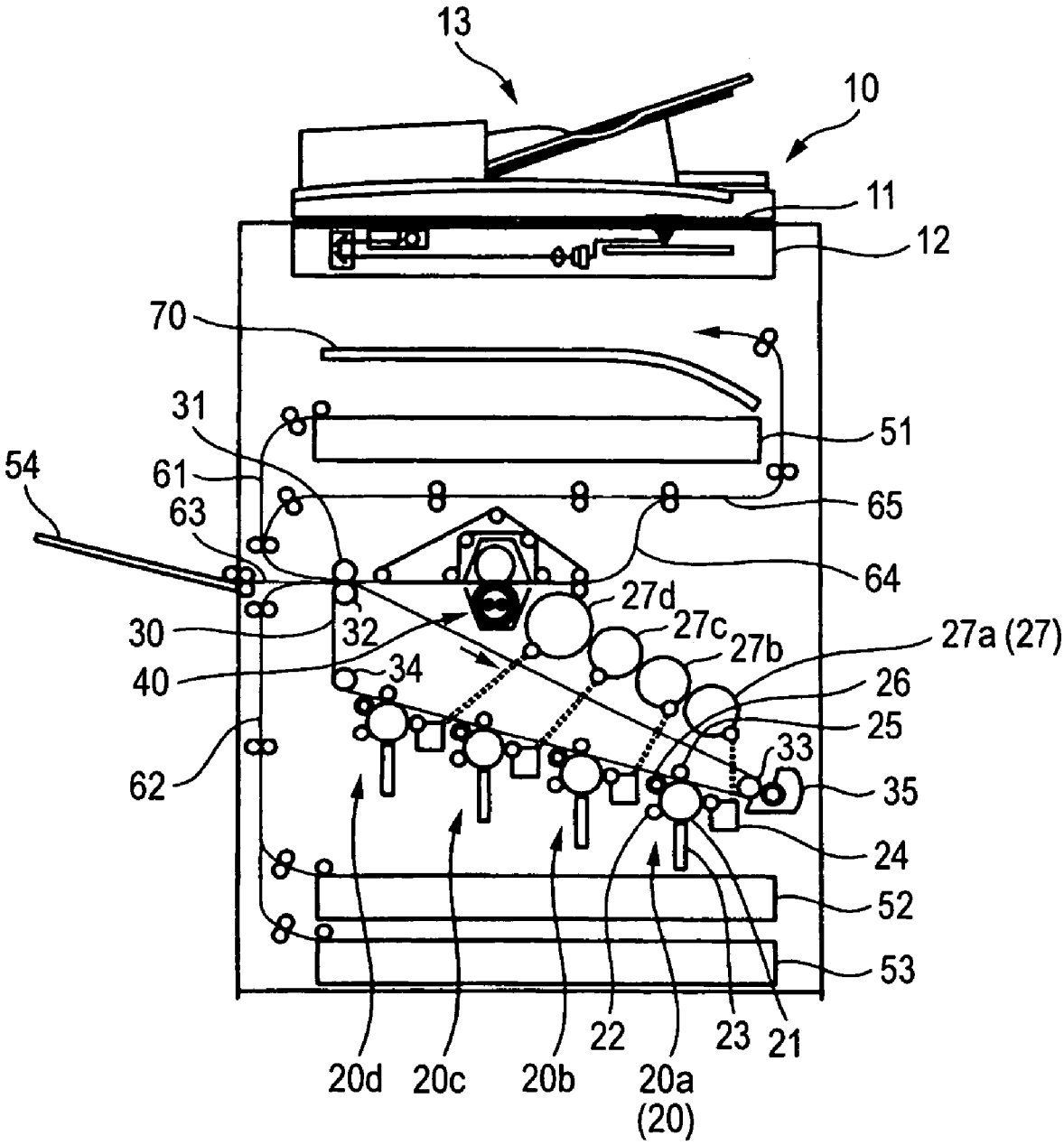
FIG. 2 is a schematic explanatory diagram showing an image forming device according to the first embodiment.

FIG. 2 is a schematic diagram showing the first embodiment of the image forming device to which the invention is applied.

In the figure, the image forming device includes a document reading device 10 to read a document on a platen 11, image forming units 20 (20*a* to 20*d*) to form images (toner images) of four respective color components (yellow, magenta, cyan, black in this embodiment) based on the electrophotographic system, for example, an intermediate transfer belt 30 to sequentially transfer (primarily transferring) and hold the images of the respective color components formed by the image forming units 20, a device 31 to collectively transfer (to secondarily transfer) a superimposed image transferred on the intermediate transfer belt 30 to a sheet of paper (recording medium), a fixing device 40 to fix the secondarily transferred image on the sheet of paper, paper feed trays 51 to 53 to supply various sizes of sheets of paper, a paper exit tray 70 to house sheets of paper on which toner images are formed and a plural paper transport paths to transport sheets of papers from the paper feed trays 51 to 53 to the paper exit tray 70.

In this embodiment, the document reading device 10 is constituted, for example, by a document reading portion 12 disposed beneath the platen 11 and an ADF (Auto Document Feeder) 13 disposed above the platen 11. The document reading portion 12 includes a light source to irradiate the surface of a document set on the platen 11, a photoelectric conversion element such as a CCD to convert a reflection light from the document surface into an electric signal, a suitable numbers of mirrors which forms a path to introduce the reflection light from the document surface to the photoelectric conversion element, and a converging lens to converge the reflection light from the document surface on the image forming surface of the photoelectric conversion element, etc. The document reading device 10 is arranged to read a document manually set or set through the ADF 13 on the platen 11 and convert the read information into an image data corresponding to the document.

Each of the image forming units 20 (20*a* to 20*d*) includes a photosensitive drum 21 and further includes, around the periphery of the photosensitive drum 21, a charging device 22 such as a charger roller to charge the photosensitive drum 21, an exposing device 23 such as a laser scanner to write a latent image (mainly, a latent image based on image data read from the document reading device 10 or image data taken from other recording medium etc.) on the charged photosensitive drum 21, a developing device 24 to develop a latent image written on the photosensitive drum 21 by using toner of respective color components, a primary transfer device 25 for such as a transfer roller to transfer a toner image on the photosensitive drum 21 onto the intermediate transfer belt 30, and a drum cleaner 26 to remove residual toner on the photosensitive drum 21.

Incidentally, a reference numeral 27 (27*a* to 27*d*) depicts a toner supply device to supply toner to the developing device 24 so that toner of respective colors is supplied to the developing device 24.

Further, the intermediate transfer belt 30 is configured by a film-shaped endless belt with a volume resistivity almost in a range of $10^9$ to $10^{12}$ Ohm-cm which is formed by mixing conductive carbon black into polyimide resin, for example. The intermediate transfer belt is hung over three tensile rollers 32 to 34.

According to the embodiment, since the tensile roller 33 is disposed beneath the tensile roller 32, the intermediate transfer belt 30 is disposed obliquely downward. The respective image forming units 20 (20*a* to 20*d*) are disposed along the intermediate transfer belt 30 between the tensile roller 33 and the tensile roller 34 on the lower side of the intermediate transfer belt 30. Thus, toner scattered from the image forming units 20 does not influence on the intermediate transfer belt 30 and so images of a high quality with little contamination can be maintained.

Further, according to the embodiment, the tensile roller 32 serves as a backup roller for the secondary transfer device 31 in a manner that a toner image formed on the intermediate transfer belt 30 by the image forming units 20 is collectively transferred on a sheet of paper by the secondary transfer device 31. Thus, since a toner image is secondarily transferred on a sheet of paper just after forming the toner image on the intermediate transfer belt 30, the toner image on the intermediate transfer belt 30 is prevented from being distorted and so images of more improved quality can be formed.

Incidentally, a reference numeral 35 depicts a belt cleaner to clean residual toner on the intermediate transfer belt 30.

Figure 3:
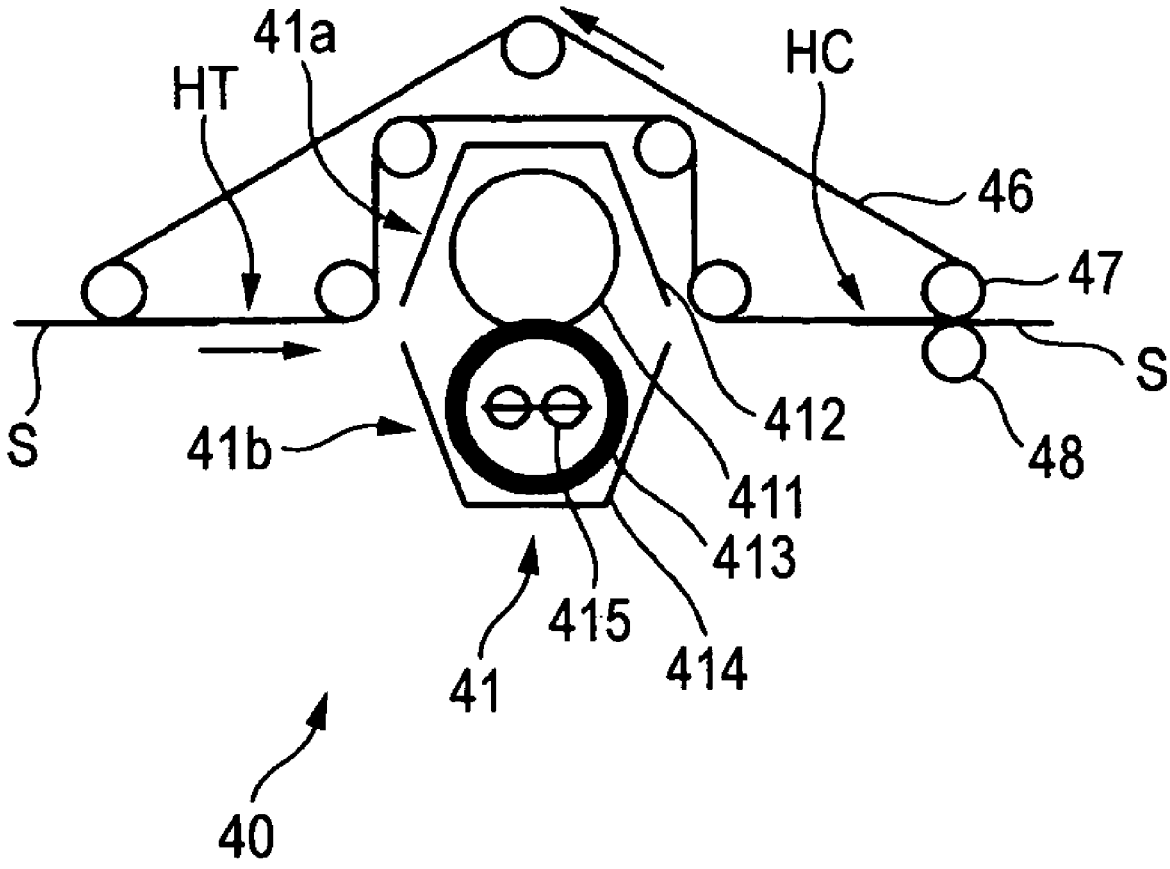
FIG. 3 is an explanatory diagram showing a fixing device according to the first embodiment.

The fixing device 40 according to the embodiment is disposed almost in the horizontal direction with respect to the secondarily transfer position and has the configuration as shown in FIG. 3.

In the figure, the fixing device 40 is configured by a fixer 41 serving as a heating unit to fuse and fix toner on a sheet of paper S, a heat absorption belt 46, to serve as a heat absorption transmission unit, to absorb heat on a sheet of paper S at a heat absorption portion HC on the downstream side of the fixer 41 disposed and to transmit the heat thus absorbed to a sheet of paper S at a heat transmission portion HT on the upstream side of the fixer 41, and seven tensile rollers 47 to stretch the heat absorption belt 46.

Figure 4:
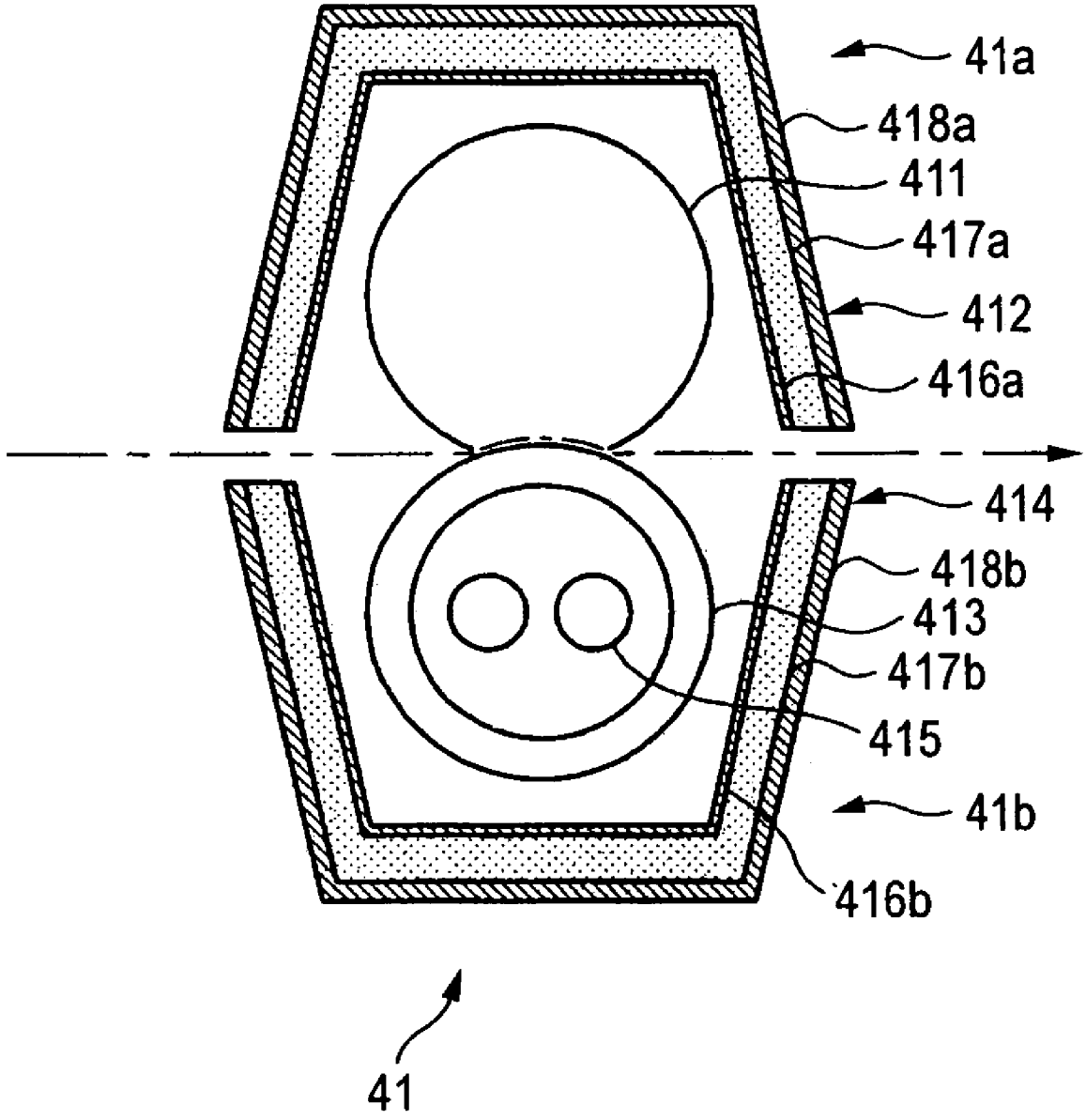
FIG. 4 is an explanatory diagram showing a fixer according to the first embodiment.

As shown in FIG. 4, the fixer 41 is configured by an upper unit 41*a* and a lower unit 41*b*. The upper unit 41*a* includes a pressure roller 411 and a heat insulation cover 412 provided so as to cover the pressure roller 411. The lower unit 41*b* includes a heat roller 413 having a heater 415 disposed therein and a heat insulation cover 414 provided so as to cover the heat roller 413. The heat insulation covers 412, 414 include heat radiation plates 416*a*, 416*b* made of metal disposed on the pressure roller 411 and the heat roller 413 sides and vacuum heat insulation members 417*a* and 417*b* covering the outside thereof, respectively. Each of reference numerals 418*a* and 418*b* depict outer covers.

In this embodiment, the pressure roller 411 and the heat roller 413 are disposed so as to be separated from the heat insulation covers 412, 414 by a distance in a range of 3 to 20 mm, for example, respectively, in a manner that the heat insulation covers 412, 414 sandwich the pressure roller 411 and the heat roller 413 therebetween in the vertical direction. Further, in this embodiment, since the pressure roller 411 and the heat roller 413 are disposed in an opposite manner in the vertical direction, a sheet of paper S is arranged to move almost in the horizontal direction at the nip part therebetween (see FIG. 3). However, the paper transport direction in this invention is not limited to this direction.

The heat absorption belt 46 shown in FIG. 3 is configured by a polyimide film with a thickness of 75 μm and serves to contact a sheet of paper S at the heat absorption portion HC on the downstream side of the fixer 41 to absorb heat of the sheet of paper S and circulate as it is, and then contact a sheet of paper S at the heat transmission portion HT on the upstream side of the fixer 41 to transmit the heat thus absorbed to the sheet of paper S.

The thermal capacity of the heat absorption belt 46 according to the embodiment is required to se suitably selected in order to absorb heat from a sheet of paper S and transmit heat to a sheet of paper S.

That is, when the thermal capacity of the heat absorption belt 46 is too small, although the rising speed of the temperature of the heat absorption belt 46 itself becomes high, absorbed heat likely radiated until absorbed heat is transmitted to a succeeding sheet of paper S even if heat is absorbed from a sheet of paper S. Further, when transmitting heat to a sheet of paper S before fixation, since the sheet of paper S cannot be heated sufficiently, it is difficult to transmit heat effectively.

In contrast, when the thermal capacity of the heat absorption belt 46 is too large, since the rising speed of the temperature of the heat absorption belt 46 itself becomes low, it needs a long time to stabilize the temperature of the heat absorption belt. Thus, since it takes a long time to transmit effective heat to a sheet of paper S before fixation, it is difficult to effectively preheat a sheet of paper S before fixation in such a using mode of printing several sheets of paper repeatedly.

Therefore, the heat absorption belt 46 may be required to have a thermal capacity in a range from almost that of a sheet of paper S to be used to several times of that in order to effectively absorb and transmit heat by using the heat absorption belt.

According to the embodiment, since the polyimide film with a thickness of 75 μm is used, the heat absorption is available from the very first sheet of paper S just after starting up the image forming device.

Further, it is also required to reduce an amount of heat absorption to the tensile roller 47 which contacts the heat absorption belt 46 in order to absorb and transmit heat by using the heat absorption belt 46.

Figure 5:
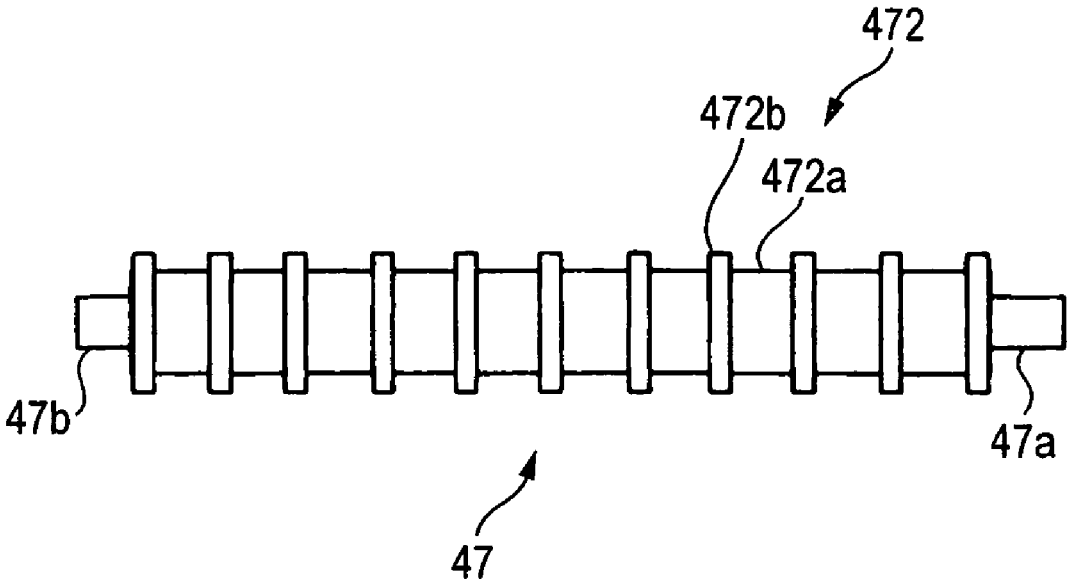
FIG. 5 is an explanatory diagram showing the schematic configuration of a tensile roller according to the first embodiment.
Figure 6:
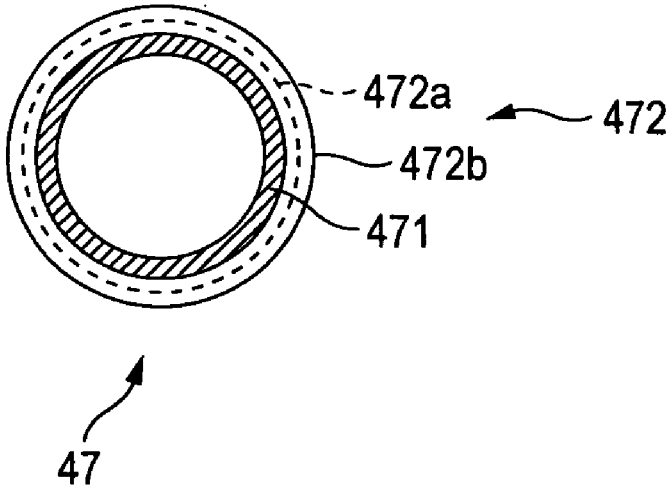
FIG. 6 is an explanatory diagram showing the sectional configuration of the tensile roller according to the first embodiment.

As shown in FIGS. 5 and 6, the tensile roller 47 is configured in a manner that a foam layer 472 made of urethane resin having a rough surface covers a SUS pipe 471 with a thin thickness, and the concave portions 472*a* and the convex portions 472*b* of the foam layer 472 are formed in the direction orthogonal to the shaft of the tensile roller 47. Incidentally, reference numerals 47*a* and 47*b* in FIG. 5 depict rotation shafts provided at the both ends of the tensile roller 47.

In this embodiment, since the surface of the tensile roller 47 is covered by the foam layer 472 and the foam layer 472 is formed to have the rough surface, an amount of heat absorbed from the heat absorption belt 46 at the time of contacting with the heat absorption belt 46 is reduced. Further, since the SUS pipe 471 with a thin thickness is used, the thermal capacity of the tensile roller 47 itself can be made small. Thus, even when the temperature of the tensile roller 47 increases due to the thermal transmission thereto etc., the tensile roller 47 can saturate quickly and so an amount of excessive heat absorbed at the tensile roller 47 is small.

Therefore, the heat absorption and transmission of the heat absorption belt 46 can be performed more effectively.

Further, in this embodiment, a charging device (not shown) such as a corotron to apply charging electric charges to adhere a sheet of paper S to the heat absorption belt 46 is disposed at the inside of the heat absorption belt 46 on the upstream side of the fixer 41. In this embodiment, an exit portion to eject a sheet of paper S after fixation from the fixing device is configured by the tensile roller 47 positioned on the downstream side of the heat absorption belt 46 and an ejection roller 48 disposed in opposite to the tensile roller 47. The ejection roller 48 has the same configuration as the tensile roller 47 (see FIG. 3).

Further, as shown in FIG. 2, in this embodiment, the paper feed trays 51 to 53 are separately disposed at the upper and lower portions of the image forming device. When sheets of paper used frequently are housed within the paper feed tray 51 provided at the upper portion, a user can supply sheets of paper within the paper feed tray 51 at an easy posture. Furthermore, in this embodiment, since the paper ejection tray 70 is disposed above the paper feed tray 51, a user also can absorb sheets of paper ejected within the paper ejection tray 70 at an easy posture. Incidentally, a reference numeral 54 depicts a manual paper feed tray, provided at the side portion of the image forming device, in which a manual feed paper can be inserted.

The paper transport path according to the embodiment is configured in the following manner. The paper transport paths includes a first transport path 61 extending almost just beneath from the paper feed tray 51, a second transport path 62 extending upward from the paper feed trays 52, 53, and a third transport path 63 extending from the manual paper feed tray 54. These transport paths join at the secondary transfer portion, then continue to a main transport path 64 and extends to the paper ejection tray 70.

A turn-over transport path 65, to turn a sheet of paper over and to retune the sheet of paper to the secondary transfer portion, extends on the way of the main transport path 64. Many transport rollers are disposed at these transport paths so as to surely transport sheets of paper.

Next, the basic image forming process of the image forming device according to the embodiment will be explained with reference to FIG. 2. When image data of respective color components (yellow, magenta, cyan, black) read by the document reading device 10 is sent to the exposing device 23 of the respective image forming units 20 (20*a* to 20*d*), latent images of respective color components are formed on the drums 21 of the image forming units 20, and the latent images are visualized by the developing devices 24 in which corresponding color toners are housed, respectively, whereby toner images of respective color components before fixation are formed on the drums 21.

The toner images of respective color components before fixation are sequentially primarily transferred and overlapped on the intermediate transfer belt 30 by the primary transfer devices 25 at the primary transfer portions where the drums 21 contact the intermediate transfer belt 30, respectively.

The toner image before fixation thus primarily transferred on the intermediate transfer belt 30 is transported to the secondary transfer portion, which is the joining point among the first transport path 61, the second transport path 62 and the third transport path 63, in accordance with the rotation of the intermediate transfer belt 30.

At the secondary transfer portion, by a not-shown transfer bias applied between the secondary transfer device 31 and the tensile roller 32, toner images before fixation on the intermediate transfer belt 30 are collectively transferred on a sheet of paper transported from the paper feed tray 51 etc., for example. The toner images before fixation collectively transferred on the sheet of paper is fixed by the fixing device 40 and ejected into the paper ejection tray 70 via the main transport path 64.

The operation of the fixing device 40 in such an image forming process will be explained in detail based on FIG. 3.

When the sheet of paper S, on which toner images before fixation are transferred by the secondary transfer, reaches the heat absorption belt 46 charged by a not-shown charging device, the sheet of paper is adhered toward the heat absorption belt 46 side. In this embodiment, since toner images before fixation are transferred on the lower side of the sheet of paper S, toner images are not particularly degraded even if the sheet of paper S is adhered toward the heat absorption belt 46 side.

A sheet of paper is peeled from the belt 46 by using a firm portion of a sheet of paper S or a detaching hook etc. before the sheet of paper reaches the fixer 41, then directed toward the fixer 41 side and passed through the nip part between the pressure roller 411 and the heat roller 413 of the fixer 41, whereby toner images before fixation on the sheet of paper S are fixed. The sheet of paper S after fixation is again adhered by the charged belt 46 and transported to the exit portion (constituted by the exit roller 48 and the tensile roller 47 disposed in opposite thereto). Since the moving speed of the heat absorption belt 46 is set to be same as the moving speed of a sheet of paper at the nip part between the pressure roller 411 and the heat roller 413 of the fixer 41, there is not particularly any problem in the transport property of a sheet of paper S. In the case of detaching a sheet of paper by using a firm portion of the sheet of paper, the exit roller 48 may not be used.

In the fixing device 40, a sheet of paper S ejected from the fixer 41 is heated by the heat roller 413 and so the temperature of the sheet of paper is high (normally, since the temperature of a sheet of paper increases to the melting point of the toner being used or more, the temperature of the sheet of paper is kept almost to the same value even just after the sheet of paper is ejected from the fixer 41). The sheet of paper S contacts the heat absorption belt 46 at the heat absorption portion HC on the downstream side of the fixer 41, so that the heat of the sheet of paper S is transmitted to the heat absorption belt 46 side to increase the temperature of the heat absorption belt 46. In this case, since a thin belt is used as the heat absorption belt 46, the thermal capacity of the heat absorption belt 46 can be made small to some extent and hence the temperature increase speed of the heat absorption belt (due to the heat absorption) can be made fast. Further, in this case, since one side surface of a sheet of paper S is exposed to the atmosphere, the heat of a sheet of paper S is effectively transmitted to and absorbed by the heat absorption belt 46 side with a small thermal resistance.

Furthermore, after the heat is absorbed at the heat absorption portion HC, the heat absorption belt 46 circulates as it is along the circulation path and contacts a sheet of paper S to be transported next at the heat transmission portion HT on the upstream side of the fixer 41, whereby the heat having been absorbed at the heat absorption portion HC is transmitted to the sheet of paper S to preheat the sheet of paper.

That is, according to the embodiment, since the polyimide film with a thickness of 75 μm is used as the heat absorption belt 46, the heat absorption belt 46 capable of absorbing heat from and transmitting heat to a sheet of paper can be realized. Further, since the aforesaid tensile roller 47 is used as a tensile roller 47 to support the heat absorption belt 46, an amount of heat absorbed to the tensile roller 47 contacting with the heat absorption belt 46 (that is, heat is absorbed to the tensile roller 47 and so the temperature of the heat absorption belt 46 decreases extra) is suppressed.

Thus, in this embodiment, since a sheet of paper before fixation can be preheated effectively, a heat energy required at the time of the fixation can be made small, the image forming device suitable for energy saving can be realized. Further, since the rising speed of the heat absorption by the heat absorption belt 46 is high, the heat absorption and the preheating of a succeeding sheet of paper is possible from the first revolution of the heat absorption belt 46. Thus, an amount of heating energy at the time of the fixation can be reduced even in a using state that the printing operation of 10 sheets of paper or less is repeatedly performed. Furthermore, since the belt 46 with a small thermal capacitance is used, the heat exchange between the heat absorption belt 46 and a sheet of paper can be performed in a short time, so that the device can be miniaturized and operated at a high speed. Of course, suitable configuration of the heat absorption belt 46 may differ depending on the condition of the device to be applied.

In this embodiment, the surface of a sheet of paper on which toner images are formed is directed downward at the time of transporting the sheet of paper into the fixing device 40. However, even when the surface of a sheet of paper on which toner images are formed is directed to the heat absorption belt 46 side, the device can be used so long as the moving speed of the heat absorption belt 46 and that of a sheet of paper are controlled so as to prevent the scattering of toner.

Also, the heat absorption belt 46 itself may be disposed on the lower side of the main transport path 64 of the paper transport path. Further, as a heat source of the fixer 41, a lamp heater, for example, may be used in place of the roller so as to heat the fixer in a non-contact manner. Furthermore, a heat source may be disposed above a sheet of paper or may be disposed above and beneath a sheet of paper.

In this embodiment, although the contact time between a sheet of paper and the heat absorption portion HC on the downstream side of the fixer 41 is set to be almost same as that between a sheet of paper and the heat transmission portion HT on the upstream side of the fixer, the contact time of a sheet of paper at the heat absorption portion HC may differ from that at the heat transmission portion HT depending on the temperature difference between the heat absorption belt 46 and a sheet of paper or the configuration of the device etc.

Further, in order to prevent the heat of the heat absorption belt 46 itself from diffusing into the device, a heat shield plate using metal etc. may be provided above the heat absorption belt 46.

In this embodiment, although the heat absorption belt 46 is arranged to contact one surface of a sheet of paper, for example, two belts 46 may be provided so as to sandwich a sheet of paper by the two belts 46 therebetween at the time of the fixation. In this case, since the belts 46 themselves serve to perform the heat absorption and the heat transmission, it is not necessary to provide the charging device etc. to apply charging electric charges, for example, in order to adhere a sheet of paper on the heat absorption belt 46 side, whereby the configuration to transport a sheet of paper can be simplified. In this case, the belts 46 having the substantially same thickness may be provided so that each of the two belts 46 performs the substantially same heat exchange with a sheet of paper. Otherwise, the two heat absorption belts may have different thicknesses so that one of these absorption belts performs more heat exchange than the other.

Figure 7:
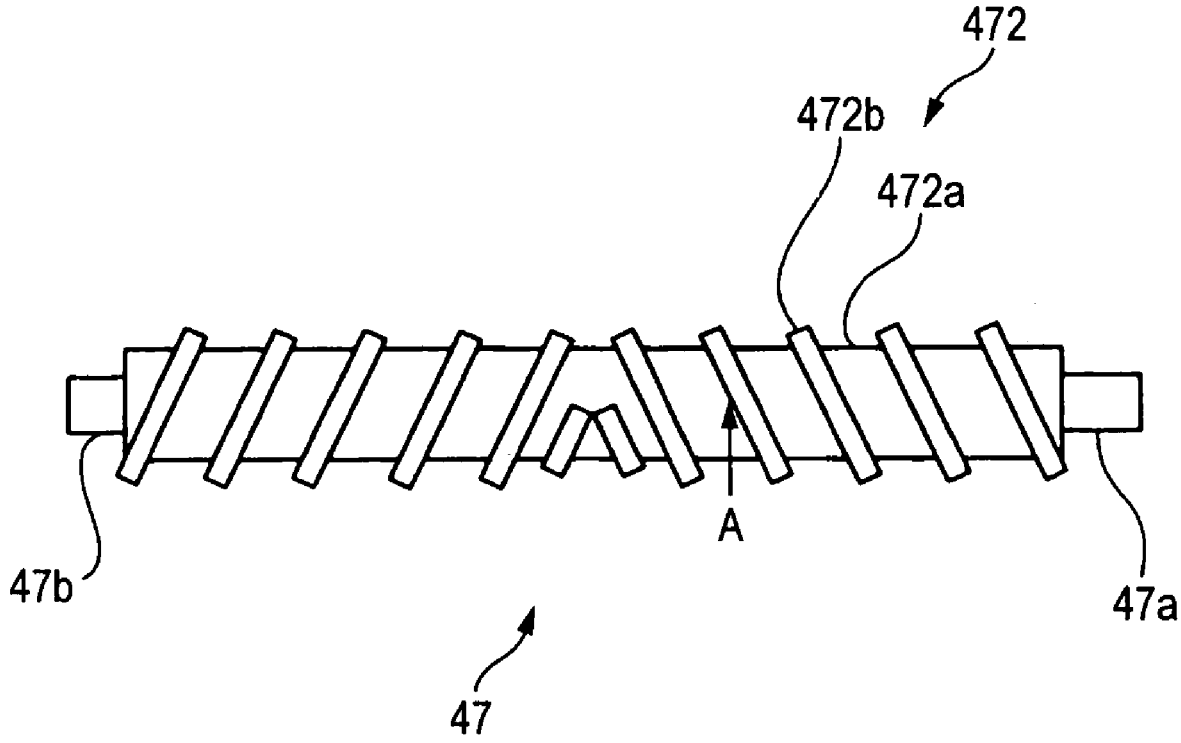
FIG. 7 is an explanatory diagram showing a modified example of the tensile roller according to the first embodiment.

FIG. 7 shows another tensile roller 47 which differs only in its configuration from the tensile roller 47 (see FIG. 5) used in the aforesaid embodiment. In the tensile roller of this figure, the foam layer 472 as a heat insulation layer is processed so as to have the surface configuration (uneven surface configuration) as shown in the figure.

The tensile roller 47 has convex portions 472*b* disposed obliquely with respect to the roller shaft thereof. In this configuration, when rotation shafts 47*a*, 47*b* are set so as to rotate the convex portions 472*b* in an arrow A direction in this figure, a force to pull the heat absorption belt 46 (see FIG. 3) toward the outside of the heat absorption belt (the direction orthogonal to the moving direction of the heat absorption belt) can be applied always to the heat absorption belt when the tensile roller 47 rotates, whereby the circulation posture of the heat absorption belt 46 can be further stabilized.

In this case, since a foam layer 472 similar to that of the aforesaid embodiment is formed, this example can also suppress an amount of heat absorbed from the heat absorption belt 46, so that the image forming device realizing the saving-energy can be provided.

SECOND EMBODIMENT

Figure 8:
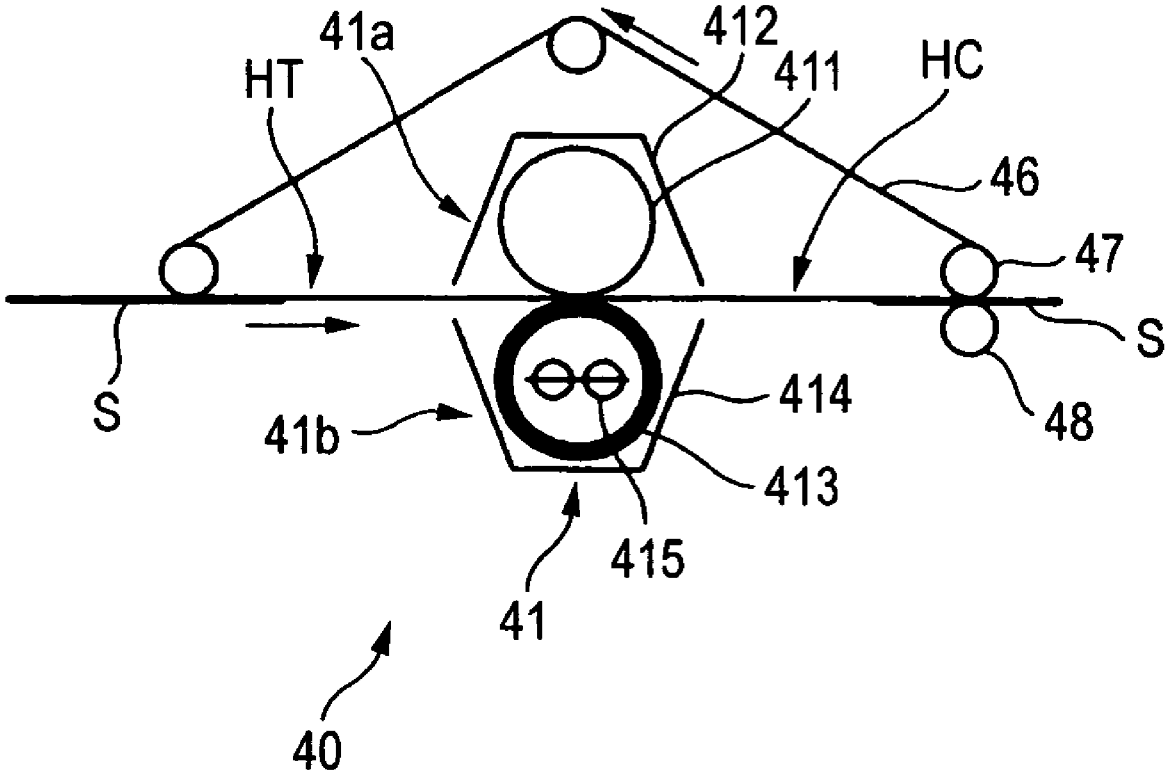
FIG. 8 is an explanatory diagram showing the fixing device of an image forming device according to the second embodiment.

FIG. 8 shows the second embodiment of a fixing device 40 used in the image forming device according to the invention.

Since the basic configuration of the image forming device according to this embodiment is same as that of the first embodiment, the explanation thereof is omitted and only the fixing device 40 is illustrated. In the figure, constituent elements similar to those of the first embodiment are referred to by the common symbols to those of the first embodiment, with detailed explanation thereof being omitted.

The fixing device 40 according to this embodiment is one of belt nip type in which a heat absorption belt 46 is arranged to pass within a fixer 41.

Although the configuration of the fixer 41 is similar to that of the first embodiment, since the heat absorption belt 46 passes at the nip part between the pressure roller 411 and the heat roller 413 of the fixer 41, the rising speed of the temperature of the heat absorption belt 46 is faster than that of the first embodiment.

The heat absorption belt 46 in this embodiment is further driven by the aforesaid nip part to circulate, so that a sheet of paper S absorbed to the heat absorption belt 46 at the heat transmission portion HT on the upstream side of the fixer 41 moves as it is to the ejection portion (constituted by the ejection roller 48 and the tensile roller 47 disposed in opposite thereto) together with the movement of the heat absorption belt 46.

In this embodiment, since a sheet of paper S is absorbed and transported by the heat absorption belt 46, a sheet of paper is prevented from winding around the fixer 41 to cause a jam.

Since this embodiment is configured in this manner, the heat absorption portion HA on the downstream side of the fixer 41 exists over a long length from the nip part of the fixer 41 to the ejection portion, the heat absorption of the heat absorption belt 46 can be performed effectively. Thus, the rising speed of the temperature of the heat absorption belt 46 can be made fast. Further, the thermal capacity of the heat absorption belt 46 can be made larger than that of the first embodiment, so that heat can be sufficiently transmitted to a sheet of paper at the heat transmission portion HT. In this case, since a fixing energy is further consumed when the heat absorption belt 46 is directly heated at the nip part, this embodiment is arranged to heat the heat absorption belt 46 via a sheet of paper S. Further, in this embodiment, when the heat absorption belt 46 is formed by polyimide resin with high heat resisting property, the thermal degradation of the heat absorption belt 46 can be suppressed even when the heat absorption belt 46 is passed within the fixer 41.

Thus, this embodiment can attain the similar effects as the first embodiment.

FIRST EXAMPLE

In this example, the temperature was measured in order to confirm the concrete preheating effects of a sheet of paper by using the substantially same configuration as the first embodiment.

The respective conditions in this case were set as follows.

As a tensile roller, there was used one which was arranged to cover hard urethane foam (thermal conductivity in a range of 0.01 to 0.05 W/(mK)) with a thickness of 3 mm on the surface of a SUS pipe having an outer diameter of 13 mm and a thickness of 0.5 mm. In this example, in order to simplify the configuration, the tensile roller was not configured that the surface of the heat insulation layer thereof was formed in an uneven shape but configured that the heat insulation layer with the even surface was covered by the urethane foam.

Further, a sheet of paper of A4 size P paper (basis weight of 65 gsm) made by Fuji Xerox Co. Ltd. was used in a manner that the paper was fed in a long edge side feeding manner (LEF).

When the printing operation was performed under the aforesaid condition in a manner that the surface temperature of the heat roller of the fixer was kept at 160° C. and 45 sheets of paper were printed per one minute (paper feed speed at the fixer is 210 mm/s), it was confirmed that absorbed heat was transmitted to a succeeding sheet of paper when the heat absorption belt circulated by one revolution after heat was absorbed from the first sheet of paper. As a concrete result, it was observed that the temperature of the sheet of paper increased to 35° C. when the room temperature was 25° C. Further, the temperature of the sheet of paper increased to 38° C. when the heat absorption belt circulated by ten revolutions (corresponding to 24 sheets of paper of A4 size).

That is, an amount of heat energy at the fixer could be reduced by an amount corresponding to the increased temperature of a sheet of paper at the time of starting the fixation.

Further, as a comparative example, the similar experiment was performed by using the tensile roller which was configured only by the SUS pipe having no heat insulation layer on the surface thereof. In this case, it was confirmed that the temperature of the sheet of paper increased to 26° C. when the heat absorption belt circulated by one revolution and so there was no heat absorption effects. Thus, it was confirmed that the provision of the heat insulation layer at the tensile roller resulted in the clerical effective effects.

SECOND EXAMPLE

This example was experimented in the similar method as the first example but the tensile roller used in this example differs in the configuration from that of the first example.

In this example, the tensile roller (see FIGS. 5 and 6) having the same configuration as that of the first embodiment was used. The tensile roller was arranged in a manner that projections each having a width of 1.5 mm and a height of 3 mm were provided with an interval of 7 mm on the surface of the SUS pipe with a thickness of 0.5 mm. Unlike the first example, the heat insulation layer used in this example was made of resin with a thermal conductivity of 0.2 W/(mk) or less.

In this example, it was confirmed that, even if there was employed the tensile roller which was made of resin (not a foam material) with a thermal conductivity larger than that of the first example, the contact area between the tensile roller and the heat absorption belt can be reduced by providing the uneven surface on the tensile roller, whereby the effects similar to that of the first example was obtained.

Incidentally, the reduction of the contact area (the area of the projection) between the tensile roller and the heat absorption belt is preferable in that an amount of heat absorbed from the heat absorption belt becomes small. However, the contact area changes depending on the rigid state of the heat absorption belt, and winkles appear in the heat absorption belt due to the projections depending on the tension of the heat absorption belt, so that the absorbability of a sheet of paper to the heat absorption belt may be influenced. Thus, the projections are required to be selected suitably so as not to cause such a phenomenon.

THIRD EXAMPLE

In this example, the preheating effects was evaluated at the time of changing a thermal capacity of the heat absorption belt in the configuration of the example 1.

In this example, the heat absorption belt with a thickness of 75 μm and the heat absorption belt with a thickness of 300 μm were used. In this case, the heat absorption belt with a thickness of 75 μm was formed by a polyimide film with a thickness of 75 μm, and the heat absorption belt with a thickness of 300 μm was formed by laminating a silicon rubber sheet on the back surface of a polyimide film with a thickness of 75 μm.

Like the first example, the tensile roller was arranged to cover hard urethane foam (thermal conductivity in a range of 0.01 to 0.05 W/(mK)) with a thickness of 3 mm on the surface of a SUS pipe having an outer diameter of 13 mm and a thickness of 0.5 mm. Further, the tensile roller was not configured so as not to form an uneven surface but to form an even surface.

As the measurement of the preheating effects, the temperature of a sheet of paper just before the entering into the fixer was measured, and the changes of the temperature of the sheet of paper was measured in accordance with the time lapse from the start of the fixation (start of passing through the fixer).

Figure 9:
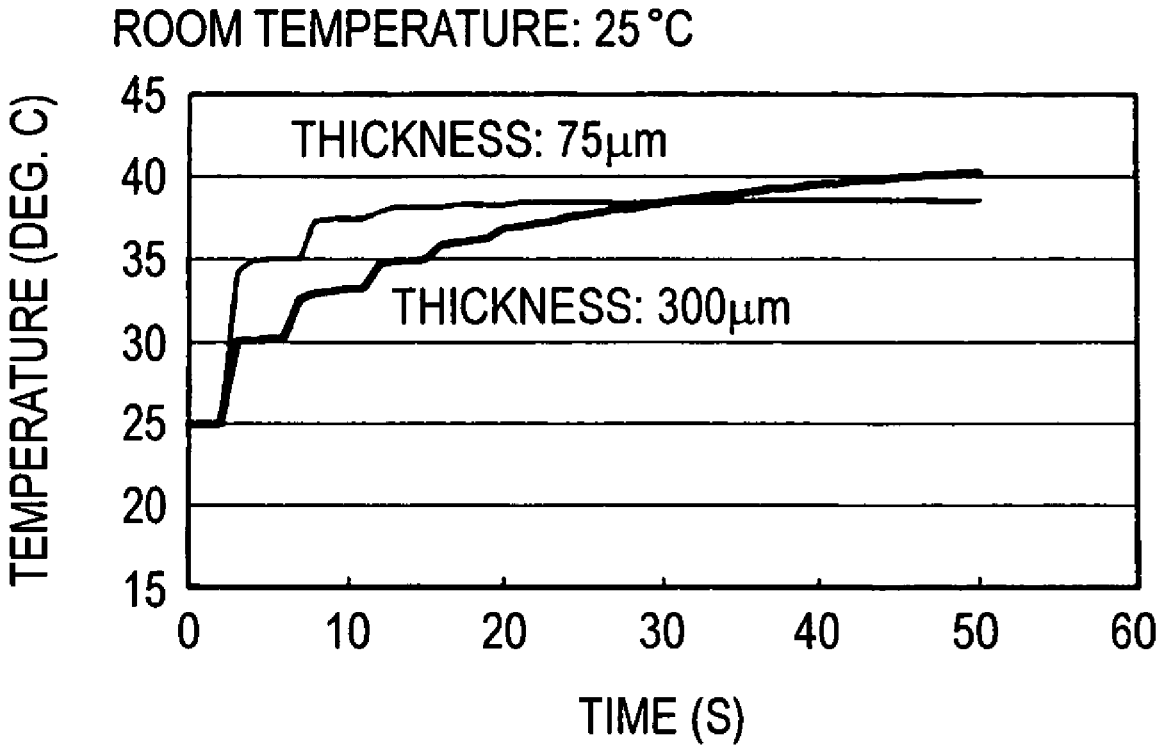
FIG. 9 is an explanatory diagram showing the result of the third example.
Figure 10:
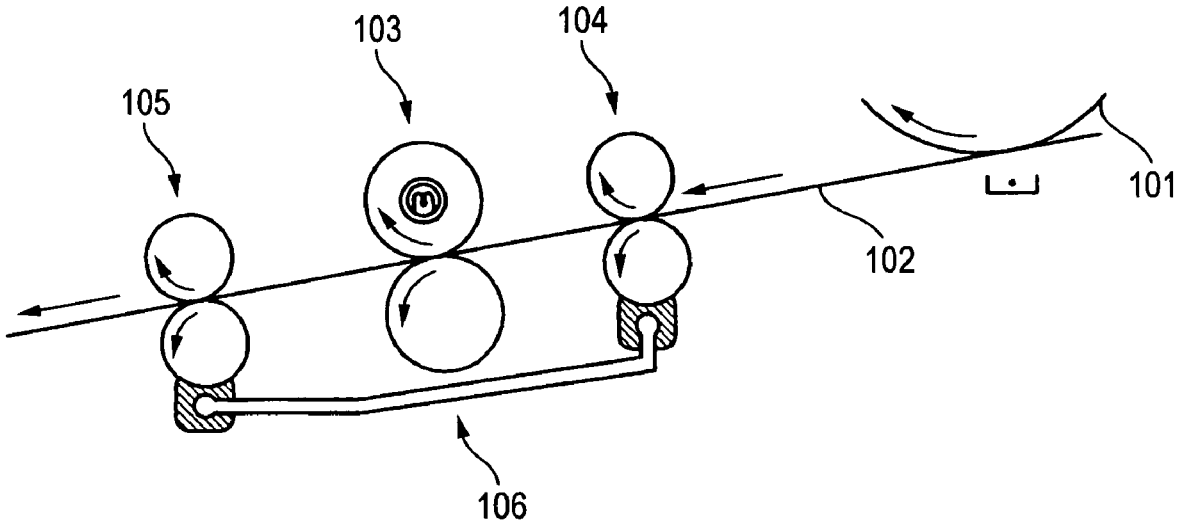
FIG. 10 RELATED ART
FIG. 10 is an explanatory diagram showing a conventional fixing device using a heat pipe.
Figure 11:
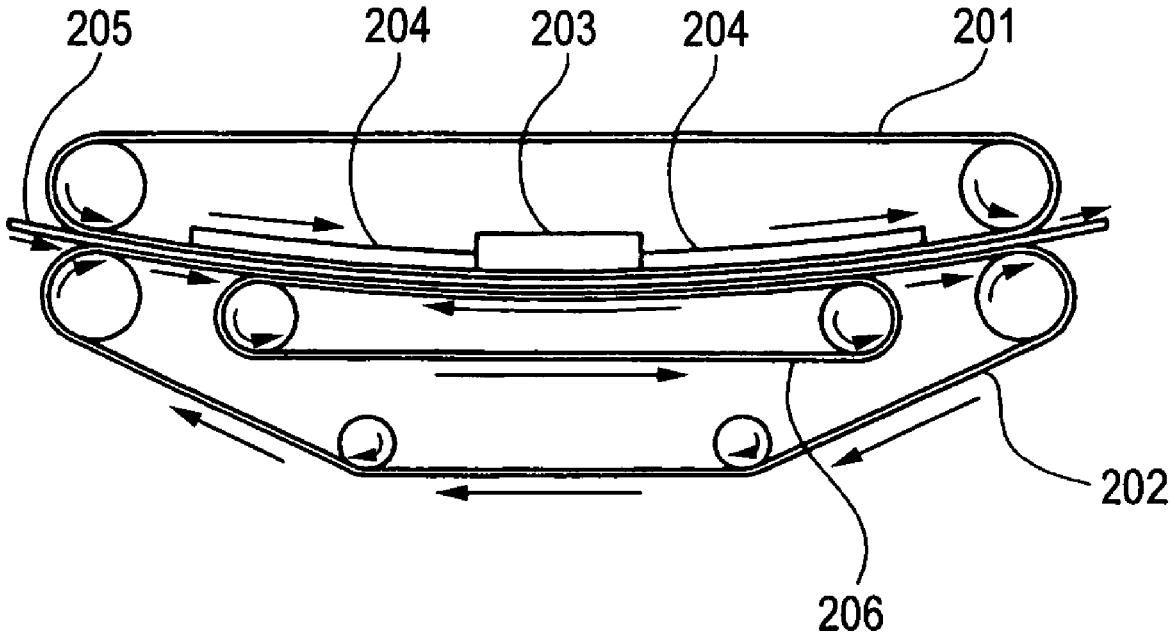
FIG. 11 RELATED ART
FIG. 11 is an explanatory diagram showing a conventional fixing device using a heat transmission belt.

The measurement result was obtained as shown in FIG. 9 in that, as to the heat absorption belt with the thickness of 75 μm, the temperature of the sheet of paper rose quickly, and reached 38° C. and almost saturated upon the lapse of about 10 sec from the start of the fixation. In contrast, as to the heat absorption belt with the thickness of 300 μm, the temperature of the sheet of paper rose slowly, then reached about 33° C. upon the lapse of about 10 sec from the start of the fixation and did not reach the saturated state even upon the lapse of 50 sec and increased gradually. Further, as to the heat absorption belt with the thickness of 300 μm, the temperature of the sheet of paper increased over 38° C. which was the temperature of the sheet of paper using the heat absorption belt with the thickness of 75 μm upon the lapse of about 30 sec.

In other words, the temperature of the sheet of paper rose quickly when the heat absorption belt (the belt with the thickness of 75 μm in this example) with the thickness (thermal capacity) almost same as that of the sheet of paper was used. In contrast, when the heat absorption belt with the large thickness was used, the temperature of the sheet of paper rose slowly. However, when the paper passing time period became longer, the temperature of the sheet of paper due to the heat absorption (heat absorption efficiency) became higher as to the belt with the large thickness rather than the belt with the small thickness due to the thermal storage effects of the belt.

This result suggests that the heat absorption efficiency can be optimized by changing the thickness of the belt in accordance with the using state of the device. That is, the belt with a small thickness may be used in the using mode of printing a small number of sheets of paper occasionally. In contrast, the belt with a relatively large thickness may be used in the using mode of printing several tens of sheets of paper or the using mode of printing sheets of paper continuously.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Application No. 2004-226794 filed on Aug. 3, 2004 including specification, claims, drawings and abstract is incorporated herein by reference in its entirety.

What is claimed is:

1. A fixing device comprising:

a heat unit that heats a toner image on a first recording medium; and a heat absorption and transmission unit that absorbs heat of the first recording medium sent from the heat unit and transmits the heat thus absorbed to a second recording medium to be sent to the heat unit, wherein the heat absorption and transmission unit comprises a belt member which is stretched over and circulated around a plurality of tensile members to transport the first and second recording media, the belt member having a heat absorption portion downstream from the heat unit and a heat transmission portion upstream from the heat unit, wherein the heat absorption portion contacts the first recording medium and absorbs heat from the first recording medium in a state that periphery of a contact region between the belt member and the first recording medium and transmits heat to the second recording medium in a state that a periphery of a contact region between the belt member and the second recording medium is thermally insulated, and wherein the belt member is disposed to pass through a heating portion of the heat unit.

2. The fixing device according to claim 1, wherein the heat absorption portion and the heat transmission portion of the belt member contact one side surface of the first and second recording media, respectively.

3. The fixing device according to claim 2, wherein the heat absorption portion and the heat transmission portion contact one side surface of the first recording medium and a second recording medium, respectively, the surface being opposite to the surface on which the toner image has been formed.

4. The fixing device according to claim 1, wherein at least one of the plurality of tensile members has a heat insulation layer on an outermost surface thereof.

5. The fixing device according to claim 4, wherein the heat insulation layer of the tensile member is formed on a surface of a cylindrical roller made of metal.

6. The fixing device according to claim 4, wherein the heat insulation layer is formed by an elastic foam material.

7. The fixing device according to claim 4, wherein the surface of the heat insulation layer is uneven to reduce an area being in contact with the belt member.

8. The fixing device according to claim 1, wherein an outermost surface of at least one of the plurality of tensile members is uneven to reduce an area being in contact with the belt member.

9. An image forming device comprising:

an image forming unit that forms a toner image on a recording medium; and a fixing device that fixes the toner image formed on the recoding medium, wherein the fixing device comprises:

a heat unit that heats a toner image on a first recording medium; and a heat absorption and transmission unit that absorbs heat of the first recording medium sent from the heat unit and transmits the heat thus absorbed to a second recording medium to be sent to the heat unit, wherein the heat absorption and transmission unit comprises a belt member which is stretched over and circulated around a plurality of tensile members to transport the first and second recording media, the belt member having a heat absorption portion downstream from the heat unit and a heat transmission portion upstream from the heat unit, wherein the heat absorption portion contacts the first recording medium and absorbs heat from the first recording medium in a state that a periphery of a contact region between the belt member and the first recording medium is thermally insulated, and the heat transmission portion contacts the second recording medium and transmits heat to the second recording medium in a state that a periphery of a contact region between the belt member and the second recording medium is thermally insulated, and wherein the belt member is disposed to pass through a heating portion of the heat unit.

10. A fixing device comprising:

a fixer that heats a toner image on a first recording medium; and a heat absorption and transmission unit that absorbs heat of the first recording medium sent from the fixer and transmits the heat thus absorbed to a second recording medium to be sent to the fixer, wherein:

the heat absorption and transmission unit comprises a belt member which is stretched over and circulated around a plurality of tensile members to transport the first and second recording media, the belt member having a heat absorption portion downstream from the fixer and a heat transmission portion upstream from the fixer, the heat absorption portion contacts the first recording medium and absorbs heat from the first recording medium, the heat transmission portion contacts the second recording medium and transmits heat to the second recording medium, and the fixer comprises a plurality of rollers and a plurality of heat insulation covers.

11. A fixing device according to claim 10, wherein the heat absorption portion and the heat transmission portion of the belt member contact one side surface of the first and second recording media, respectively.

12. The fixing device according to claim 11, wherein the heat absorption portion and the heat transmission portion contact one side surface of the first recording medium and a second recording medium, respectively, the surface being opposite to the surface on which the toner image has been formed.

13. The fixing device according to claim 12, wherein a heat insulation layer of the tensile member is formed on a surface of a cylindrical roller made of metal.

14. The fixing device according to claim 13, wherein the heat insulation layer is formed by an elastic foam material.

15. The fixing device according to claim 13, wherein a surface of the heat insulation layer is uneven to reduce an area being in contact with the belt member.

16. A fixing device according to claim 10, wherein the belt member is disposed to be spaced apart from the fixer.

17. The fixing device according to claim 10, wherein at least one of the plurality of tensile members has a heat insulation layer on an outermost surface thereof.

18. The fixing device according to claim 10, wherein an outermost surface of at least one of the plurality of tensile members is uneven to reduce an area being in contact with the belt member.

19. The fixing device according to claim 10, wherein the fixer further includes a plurality of heat radiation plates.

20. The fixing device according to claim 10, wherein the heat insulation covers include heat radiation plates and vacuum heat insulation members.

21. The fixing device according to claim 10, wherein the heat insulation covers include an outer cover and a heat radiation plate with a vacuum heat insulation member disposed between the outer cover and the heat radiation plate.

* * * * *